US005165448A

United States Patent [19]

Handte

[11] Patent Number: 5,165,448

[45] Date of Patent: Nov. 24, 1992

[54] TWO-STAGE SERVOVALVE WITH COMPENSATOIN CIRCUIT TO ACCOMMODATE "DEAD ZONE" DUE TO OVERLAPPED SPOOL LOBES

[75] Inventor: Herbert Handte, Filderstadt, Fed. Rep. of Germany

[73] Assignee: Moog GmbH, Boblingen, Fed. Rep. of Germany

[21] Appl. No.: 749,216

[22] Filed: Aug. 23, 1991

[30] Foreign Application Priority Data

Aug. 24, 1990 [EP] European Pat. Off. ..... 90116279.2

[51] Int. Cl.[5] ..... F15B 13/043

[52] U.S. Cl. ..... 137/625.64; 137/625.62

[58] Field of Search ..... 137/625.62, 625.64

[56] References Cited

U.S. PATENT DOCUMENTS 4,192,551 3/1980 Weimer et al. ..... 91/459 X 4,466,337 8/1984 Eiler ..... 137/625.65 X 4,766,921 8/1988 Williams ..... 137/625.65 X

*Primary Examiner*—Gerald A. Michalsky

[57] ABSTRACT

A two-stage flow-control electrohydraulic servovalve has a pilot-stage (14) and a second-stage valve spool (6) mounted for sliding movement relative to a body (1). The pilot-stage (14) is arranged to provide an output pressure, which is used to selectively displace the second-stage spool (6) relative to the body, to establish flow through the second-stage. The second-stage spool has a plurality of lobes, which are overlapped with respect to passageways communicating with the control ports (3,4). A spool position feedback servoloop is closed about the second-stage valve spool and the pilot-stage. The improvement provides a compensation circuit (21) for modifying the command signal ($e_c$) so as to compensate for the "dead zone" in the normal second-stage flow-to-displacement characteristics, such that the second-stage output flow will be substantially proportional to the command signal.

9 Claims, 3 Drawing Sheets

TWO-STAGE SERVOVALVE WITH COMPENSATOIN CIRCUIT TO ACCOMMODATE "DEAD ZONE" DUE TO OVERLAPPED SPOOL LOBES

TECHNICAL FIELD

The present invention relates generally to the field of two-stage electrohydraulic servovalves, and, more particularly, to an improved two-stage servovalve having a compensation circuit operatively arranged to modify the command signal so as to improve the linearity of the second-stage output flow-to-command signal characteristics of the valve, notwithstanding the provision of a deliberate "dead zone" in the output flow-to-spool displacement characteristics due to an overlapped spool lobe.

BACKGROUND ART

Two-stage electrohydraulic servovalves (sometimes called "proportional control" valves) are in common use in industrial applications to control the flow of fluid, or pressure, with respect to a load. These are typically used to control the position of a load in response to a command signal.

Some applications require a "fail-safe" behavior of the valve such that, when either supply pressure or electrical power is lost, flow through the output-stage will be blocked. To provide this behavior, the second-stage valve spool may be mechanically centered by springs, which function to return the spool to a centered or null position in the absence of supply pressure or electrical power. In some cases, a bypass circuit is provided to equalize the pilot-stage output pressures in the event of an electrical failure, so as to allow the centering springs to return the second-stage spool to its centered or null position. The second-stage valve spool typically has lobes which are overlapped with respect to control ports so that there will be minimum leakage from the supply pressure to the load, or from the load to the return, when the valve spool is in its centered or null position.

The provision of overlapped spool lobes introduces significant non-linearity in the second-stage output flow-to-command signal characteristics of the valve, particularly if second-stage valve spool displacement is a linear function of the input current, as is customary with flow-control servovalves. The output flow vs. input current characteristics of zero-lapped, overlapped and under-lapped spool lobes are comparatively shown and described in U.S. Pat. No. 4,766,921, the aggregate disclosure of which is hereby incorporated by reference. In many cases, it is desired to provide an overlapped spool lobe with respect to a control port, so as to minimize leakage flow through the output stage, particularly when the load is to be held statically for long periods of time. At the same time, it would be generally desirable to improve the output flow-to-command signal characteristics of such valve in order to reduce and minimize, if not substantially eliminate, the effect of the "dead zone" attributable to such overlapped spool lobes.

DISCLOSURE OF THE INVENTION

The present invention provides a unique improvement for use with a two-stage electrohydraulic servovalve (i.e., either a three-way valve or a four-way valve) associated with a fluid source and a fluid return and operatively arranged to control a flow of fluid through a control port, the servovalve having a pilot-stage adapted to be supplied with electrical current and operative to produce a pilot-stage pressure in response to said current, and having a second-stage valve spool mounted for movement relative to a body to vary the area of at least one orifice through which fluid must flow with respect to the control port, the body having a passageway communicating with the control port, the valve spool having a land which is overlapped with respect to this passageway such that, when the spool is in its null position relative to the body, the spool must be moved some distance relative to the body from its null position before the area of the orifice will be increased, the servovalve also having a spool position servoloop closed about the valve spool and the pilot-stage, this position servoloop being operatively arranged to produce a position error signal as the algebraic sum of a position command signal and a negative feedback signal, and wherein the position error signal is amplified to supply current to the pilot-stage proportional to the position error signal.

The improvement broadly comprises compensation means, such as a compensation circuit, operatively associated with the position command signal for modifying the position command signal such that the "dead zone" in the second-stage output flow-to-spool displacement characteristics of the servovalve will be reduced; whereby the linearity of the output flow-to-command signal will be substantially improved.

Accordingly, the general object of the invention is to improve the linearity of the second-stage output flow-to-command signal characteristics of a two-stage electrohydraulic servovalve having at least one overlapped lobe on the second-stage valve spool.

Another object is to improve the linearity of a two-stage servovalve having at least one overlapped second-stage spool lobe, without modifying the physical structure of the servovalve.

Still another object is to provide an improved two-stage servovalve having a second-stage valve spool provided with at least one overlapped lobe to minimize leakage flows with respect to a load when such load is to held statically, and to improve the linearity of the second-stage output flow-to-command signal characteristics of the servovalve.

These and other objects and advantages will become apparent from the foregoing and ongoing written specification, the drawings, and the appended claims.

DESCRIPTION OF THE PREFERRED EMBODIMENT(S)

Figure 1:
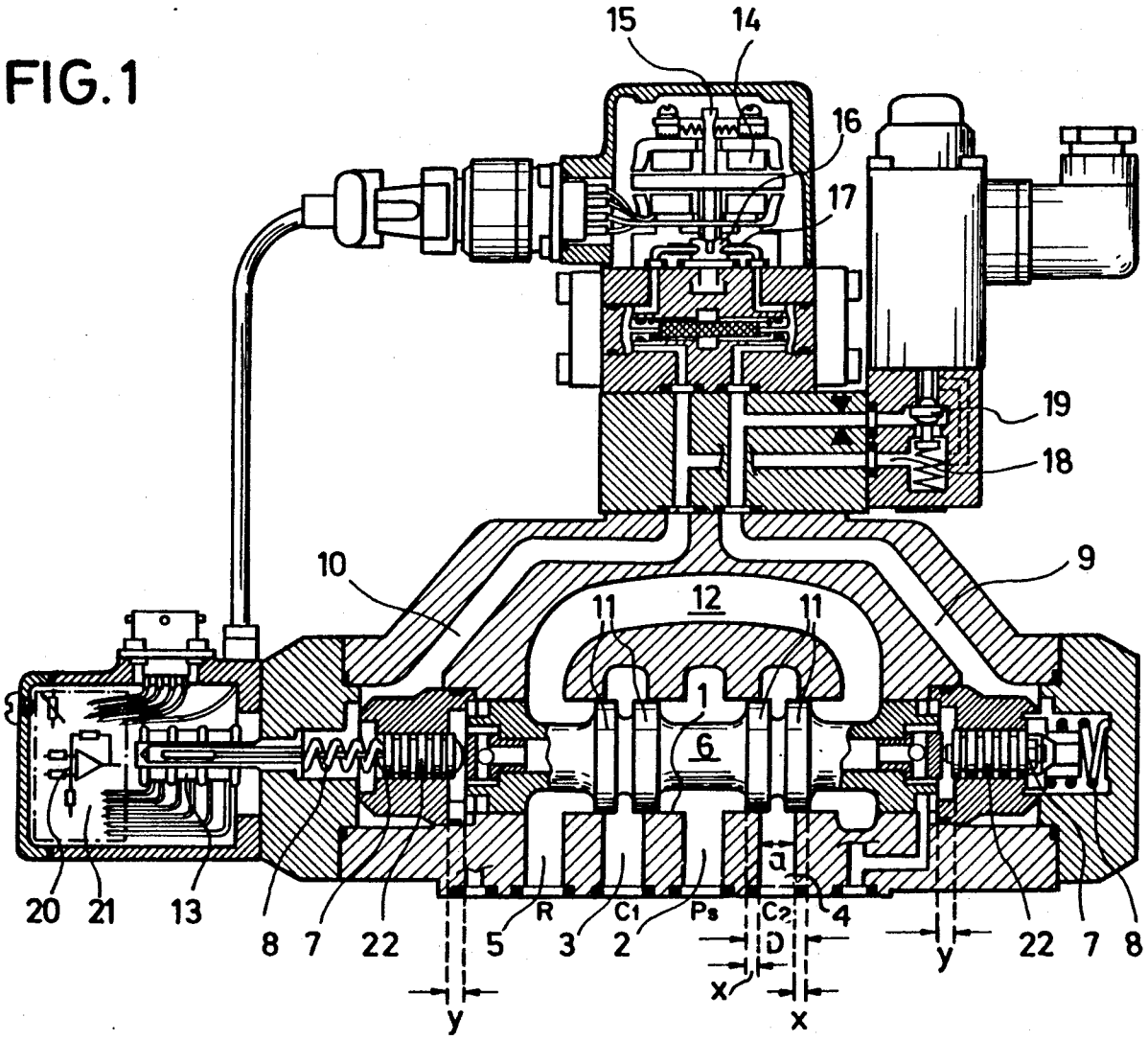
FIG. 1 is a fragmentary vertical sectional view of a two-stage flow-control electrohydraulic servovalve having a pilot-stage operatively arranged to control the pressure differential between two second-stage spool end chambers, and showing the second-stage spool as having two intermediate lobes which are overlapped with respect to passageways communicating with the control ports, this view also illustrating the servovalve as having electrical spool position feedback and as incorporating the compensation circuit of the present invention.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and, more particularly, to FIG. 1, a two-stage four-way electrohydraulic flow-control servovalve is shown as including a body 1 having a lowermost central pressure supply port 2, control ports 3, 4 on either side of supply port 2, and a leftward return port 5 communicating with a fluid reservoir (not shown). Supply port 2 is adapted to receive pressurized fluid at a supply pressure $P_S$ from a suitable source (not shown); return port 5 communicates with the fluid sump at a return pressure R; and control ports 3, 4 are arranged to provide controlled pressures $C_1$, $C_2$, respectively, to a suitable fluid-powered load (not shown).

The valve body is shown as having a horizontally-elongated bore in which a second-stage valve spool 6 is slidably mounted between two opposing actuator pistons, severally indicated at 22, arranged in the spool end chambers. The respective spool end chambers communicate with the pilot stage via passageways 9, 10. The second-stage valve spool is formed with two pairs of axially-spaced intermediate lobes straddling control ports 3 and 4. Each intermediate lobe is shown as having two axially-spaced lands, severally indicated at 11, separated by an intermediate groove. Thus, the fluid pressures at control ports 2, 3 will act circumferentially about each respective lobe.

The two control ports 3, 4 each are severally depicted as having a diameter a corresponding to the width of the annular grooves provided in the body so as to surround the bore. The two lands of each lobe are axially spaced from one another such that their overall width D is greater than the width a of the annular chambers or the diameters of the respective outlet ports 3 or 4, at the interior cylinder wall surface. When the spool is in its centered or null position relative to the body, as shown, the right and left marginal end portions of the lobes overlap the control port openings symmetrically by equal dimensions x. The maximum displacement of the spool in either direction from this null position is represented by dimensions y.

The portions of the valve stem between the two intermediate lobes and the two end lobes (which appear in section) communicate with one another via a common passageway 12.

The second-stage valve spool 6 is continuously biased to move toward its centered or null position relative to the body by a pair of opposed centering springs, severally indicated at 8, which are arranged in the spool end chambers and which act on the end faces of the actuator pistons.

An electrical position transducer 13, such as a linear variable differential transformer (LVDT), is operatively arranged to sense the position of the second-stage spool relative to the body, and is arranged to supply a negative feedback signal reflecting such sensed position to the first-stage torque motor 14. This type of electrical position servoloop is well known. The armature 15 of torque motor 14 is arranged to selectively displace a flapper 16 between two opposing nozzles of a conventional nozzle-flapper first-stage 17.

In the preferred embodiment, passageways 9 and 10 are interconnected by a bypass passageway, indicated at 18, containing an electrically-operable solenoid-type valve 19. Valve 19 is normally opened, and is arranged to be selectively moved to a closed position when a suitable electrical signal is provided thereto. In the event of an interruption or loss of this signal, valve 19 will open automatically to communicate passageways 9, 10, thereby allowing centering springs 8 to return the spool to its illustrated null position.

The invention provides compensation means, such as a compensation circuit 21, as further explained infra, for improving the linearity of the second-stage output pressure-to-command signal characteristics of the valve by modifying the command signal to compensate for the "dead zone" in the normal output flow-to-input current characteristics of the valve due to the presence of overlapped second-stage spool lobes.

Figure 2:
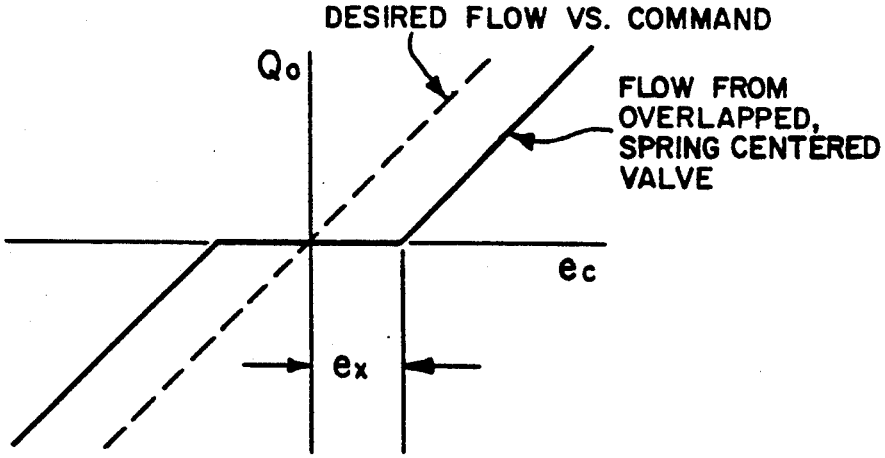
FIG. 2 is a plot of output flow ($Q_0$) versus command signal ($e_c$), and shows, in solid, the normal representative second-stage output flow-to-command signal characteristics of a second-stage spool having overlapped lobes, this view also depicting the desired output flow-to-command signal characteristics in the dashed line.

FIG. 2 depicts the normal output flow-to-command signal characteristics of a spool having overlapped lobes. Note that there is a "dead zone" centered about the origin, within which a small command signal will not produce any flow. This is due to the overlap of the spool lobes, and the fact that the spool must be displaced a distance x from the null position before the orifices will begin to open. This figure also illustrates, by means of the dashed line, the desired flow-to-command signal characteristics of a proportional servovalve.

Figure 3:
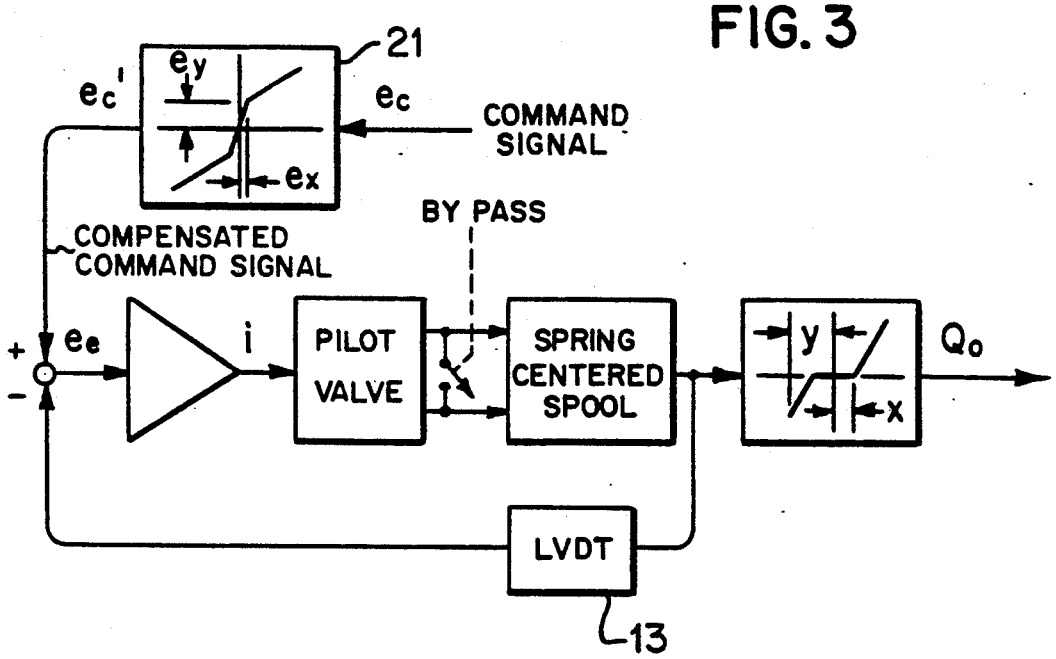
FIG. 3 is a block diagram of the improved servovalve shown in FIG. 1.

FIG. 3 is a block diagram of the improved servovalve. An electrical command signal ($e_c$) is provided as an input to compensation circuit 21, which provides a modified or compensated command signal ($e_c'$) as its output. This modified signal is supplied as a positive input to a summing point. The error signal ($e_e$) from this summing point is supplied through a servoamplifier to produce a current (i) which is supplied to the pilot-stage. The pilot-stage then supplies a differential pressure to the spool end chambers, which is used to selectively displace the second-stage spool in the appropriate direction off null, and causes the second-stage to produce an output flow $Q_0$. The actual spool position is sensed via LVDT 13, and a signal reflecting the actual position of the second-stage spool is supplied as a negative feedback signal to the summing point.

Figure 4:
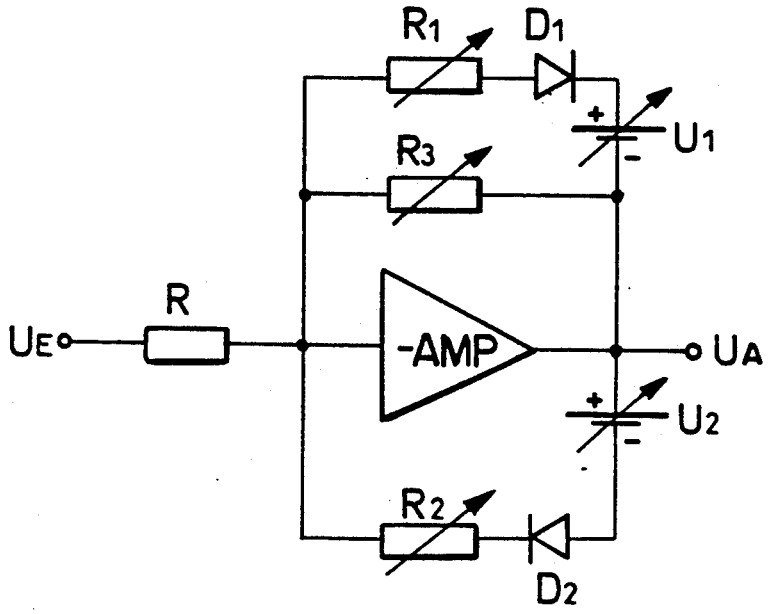
FIG. 4 is an electrical schematic of the improved compensating circuit used in association with the servovalve shown in FIG. 1.

FIG. 4 depicts a preferred arrangement of the compensation circuit 21. The input to the circuit is indicated at $U_E$, and the output thereof is indicated at $U_A$. This circuit is shown as including an inverting operational amplifier having an input resistor R, and having three branch circuits arranged in parallel with the amplifier. The first branch circuit includes a first variable resistor $R_1$, a first diode $D_1$, and a first variable voltage source $U_1$. The second branch circuit includes a second variable resistor $R_2$, a second diode $D_2$, and a second variable voltage source $U_2$. The third branch circuit includes a third variable resistor $R_3$. As mentioned above, these three branch circuits are arranged in parallel with the operational amplifier.

Assuming the presence of ideal components, the following relationships exist between the circuit output voltage $U_A$ and the input voltage $U_E$:

$$U_A = -U_E\left(\frac{R_3}{R}\right) \text{when } U_1 < U_A < U_2 \quad (1)$$

$$U_A = -U_E\left(\frac{R_1}{R}\right) \text{when } U_A < U_1 \text{ and } R_3 >> R_1 \quad (2)$$

$$U_A - U_E\left(\frac{R_2}{R}\right) \text{when } U_A > U_2 \text{ and } R_3 >> R_2 \quad (3)$$

Figure 5:
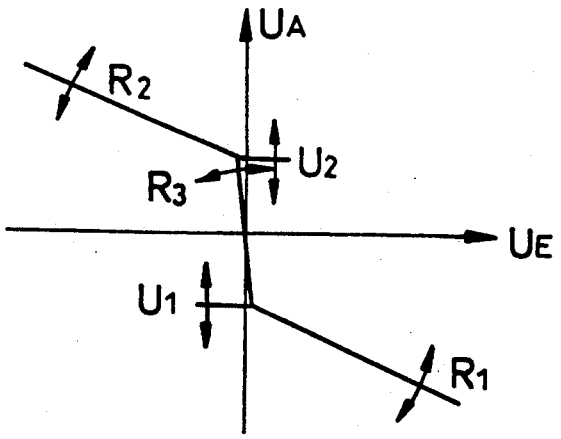
FIG. 5 is a plot of output voltage ($U_A$) versus input voltage ($U_E$) of the compensation circuit shown in FIG. 4, this view also showing the variable gain provided by the compensation circuit.

FIG. 5 graphically illustrates the relationship between the input and output signals of the compensating circuit. The various sections of the curve depicted in FIG. 4 are defined by the equations set forth above. More particularly, the slopes of various portions of the curve spaced from the origin are determined by the relationships between the feedback resistors $R_1$, $R_2$ and $R_3$, relative to the input resistor R. The smaller the ratio between the various feedback resistor and the input resistor, the smaller the slope of the respective curve portions. The ordinate position of the transition points relative to the origin is determined by variable voltage sources $U_1$ and $U_2$. Raising the lowering the values of $U_1$ and $U_2$ results in displacement of the respective transition points in the positive or negative direction, respectively, along the ordinate of FIG. 5.

Even a relatively-low positive signal ($U_E$) supplied to the input of the compensation circuit results in the generation of an output signal ($U_A$) substantially of amplitude $U_1$. This signal causes the second-stage valve spool to be displaced off null by a distance x substantially equal to the extent of overlap of the left and right marginal portions of the spool lobes. As a result, control port 4 will begin to open in response to a further increase of the input signal. Beyond this transition point, there will be a linear relationship between the command signal and the output flow through the second-stage of the valve.

The same process takes place at pressure control port 3 in response to a negative signal supplied to the input of the compensation circuit. In this case, the transition points of the curve shown in FIG. 4 correspond to those of the non-linear valve characteristic resulting from the positive overlap. The net effect thereof, in practice, is to produce a servovalve having a substantially linear output flow-to-command signal current. The "dead zone" attributable to the overlapped spool lobes is, in effect, compensated for by the variable gain supplied by the compensation circuit. As a result, the valve displays a substantially linear output flow-to-command signal characteristic over its full operating range.

Thus, the undesirable behavior of a conventional two-stage servovalve having a second-stage valve spool with overlapped lobes, can be eliminated by providing a compensation circuit in the command signal, as shown in FIG. 2. Using an analog non-linear biased-diode network technique, the compensation circuit is caused to have a very high gain around zero command input so that a very small command signal ($e_c$) can produce the modified command signal ($e_c'$) necessary to cause the spool to be displaced through its overlap region x. Beyond this, the compensation gain is reduced to provide the desired output flow-to-command signal relationship.

In the event that power to solenoid valve 19 is lost, this valve will open, thereby communicating passageway 9, 10, and allowing the springs 8 to return the second-stage valve spool to its centered or null position relative to the body. Thus, in the event of an electrical failure, the valve will fail at its centered or null position, thereby blocking flow through the valve with respect to a load.

Figure 6:
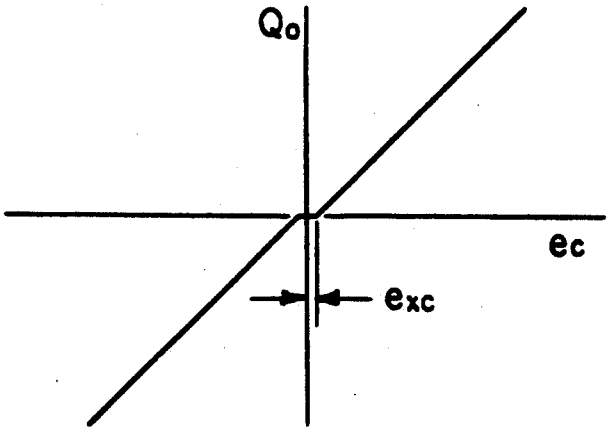
FIG. 6 is a plot of output flow ($Q_0$) versus command signal ($e_c$) of the improved servovalve, showing the compensation circuit as having caused a substantial reduction in the width of the "dead zone" due to the overlapped second-stage spool lobes.

FIG. 6 is a plot of the second-stage output flow vs. command signal characteristic of the improved valve, showing that the improved valve will have a substantially-linear flow-to-command characteristics. Notice that the width of the overlap (i.e., $e_x$) in FIG. 1, has been substantially reduced to a width of $e_{xc}$ in FIG. 6. Thus, in FIG. 6, the threshold command signal needed to produce a flow response, has been substantially reduced, and approaches to zero.

As previously noted, the principles of the improved compensating circuit may be incorporated in either a three-way valve or a four-way valve, as desired. Moreover, the improved compensation circuit may be incorporated in a pressure-control servovalve, so long as a position servoloop is closed about the load and the valve. In this case, the compensation circuit would still provide a modified actuator position signal to the servoloop.

Therefore, while a preferred embodiment of the improved servovalve has been shown and described, and several modifications thereof discussed, persons skilled in this art will readily appreciate the various additional changes and modifications may be made without departing from the spirit of the invention, as defined and differentiated by the following claims.

I claim:

1. In a two-stage electrohydraulic servovalve associated with a fluid source and a fluid return and operatively arranged to control a flow of fluid through a control port, said servovalve having a pilot-stage adapted to be supplied with electrical current and operative to produce a pilot-stage pressure in response to said current, and having a second-stage valve spool mounted for movement relative to a body to vary the area of at least one orifice through which fluid must flow with respect to said control port, said body having a passageway communicating with said control port, said valve spool having a lobe which is overlapped with respect to said passageway when said spool is in a null position with respect to said body such that said spool must be moved some distance relative to said body from said null position before the area of said orifice will be increased, and having a spool position servoloop closed about said valve spool and pilot stage, said position servoloop being operatively arranged to produce a position error signal as the algebraic sum of a position command signal and a negative feedback signal, and wherein said position error signal is amplified to supply current to said pilot-stage proportional to said position error signal, the improvement which comprises:

compensation means operatively associated with said position command signal for modifying said position command signal such that the "dead zone" in the second-stage flow-to-command signal characteristics of said servovalve will be reduced;

whereby the output flow will be substantially proportional to said command signal.

2. The improvement as set forth in claim 1 wherein said compensation means is arranged to supply a modified command signal to said position servoloop.

3. The improvement as set forth in claim 2 wherein said compensation means has a gain which varies as a function of the extent of such overlap.

4. The improvement as set forth in claim 3 wherein said compensation means has a relatively high gain within said overlap, and has a smaller gain beyond said overlap.

5. The improvement as set forth in claim 1 wherein said compensation means includes a compensation circuit in series with said command signal, and wherein said compensation circuit includes an operational amplifier arranged to receive said command signal through a fixed resistor, and has three branch circuits arranged in parallel with said amplifier.

6. The improvement as set forth in claim 5 wherein a first of said brach circuits includes a first variable resistor, a first diode, and a first variable voltage source arranged in series.

7. The improvement as set forth in claim 6 wherein a second of said branch circuits includes a second variable resistor, a second diode, and a second voltage source arranged in series.

8. The improvement as set forth in claim 7 wherein a third of said branch circuits includes a third variable resistor.

9. The improvement as set forth in claim 1 and further comprising an electrically-operated valve operatively arrange to equalize the pressures operatively arranged to permit the spool to return to its null position in the event of a loss of electrical power to the valve.

* * * * *